United States Patent [19]

Bean et al.

[11] Patent Number: 4,457,996

[45] Date of Patent: Jul. 3, 1984

[54] TRIBO INDUCTION TONER COMBINATION FOR CARRIERLESS DEVELOPMENT

[75] Inventors: Lloyd F. Bean, Rochester; Roger L. Miller, Penfield, both of N.Y.

[73] Assignee: Xerox Corporation, Stamford, Conn.

[21] Appl. No.: 309,526

[22] Filed: Oct. 7, 1981

Related U.S. Application Data

[63] Continuation of Ser. No. 813,022, Jul. 5, 1977, abandoned.

[51] Int. Cl.[3] ..... G03G 9/14

[52] U.S. Cl. ..... 430/122; 430/107

[58] Field of Search ..... 430/106.6, 107, 122

[56] References Cited

U.S. PATENT DOCUMENTS 4,082,681 4/1978 Takayama et al. ..... 430/903

4,165,393 8/1979 Suzuki et al. ..... 430/122

*Primary Examiner*—John D. Welsh

*Attorney, Agent, or Firm*—Peter H. Kondo; John E. Beck; Ronald Zibelli

[57] ABSTRACT

A toner and development process involving electrostatic development without carrier is disclosed. The toner of the invention is effectively transferred from photoreceptors to plain paper after development. The toner is formed of a combination of an insulating toner and a conductive toner that are triboelectrically active with respect to each other.

15 Claims, No Drawings

TRIBO INDUCTION TONER COMBINATION FOR CARRIERLESS DEVELOPMENT

This is a continuation of application Ser. No. 813,022, filed July 5, 1977, now abandoned.

BACKGROUND OF THE INVENTION

This invetion relates to electrophotographic development utilizing magnetic toner particles which are applied from magnetic brush to the electrostatic latent image without use of a carrier material.

A vast majority of the electrographic copying processes in use today involve creation on a suitable recording medium of an electrostatic charge pattern corresponding to a pattern of light and shadow to be reproduced and the development of that pattern by deposition of marking material on the recording medium according to forces generated by such electrical potential pattern. Xerography is the most widely known of these techniques. The substrate may be photoconductive, such as in the case of selenium as taught by Carlson in U.S. Pat. No. 2,297,691, or may be a conventional insulating substrate overlying a photoconductor layer, as described in Watanabe, U.S. Pat. No. 3,536,483 to name a few examples.

After creation the electrical potential pattern is generally developed by means of a finely divided developer powder thus giving form to the hitherto latent electrostatic image. In a common technique a fine, insulating, electroscopic powder is cascaded over the electrical potential pattern bearing member. The powder is, in the conventional use, triboelectrically charged to a definite polarity and deposits preferentially in regions of the surface where there is a preponderance of charge of the opposite polarity. The triboelectric charge is caused by presence of carrier beads in the powder mix. This technique of development is called cascade development.

In another form of development, called magnetic brush development, magnetic carriers or magnetic toners are employed. In this technique a magnetic force is used to provide adherence of the toner-carrier mixture to a support member which is then presented to the image bearing member. In comparison to cascade development, magnetic brush development fills in solid areas better, is more compact, and does not depend on gravity to present the toner to the surface, a factor which allows freedom in locating the developer station.

In yet another form of electrostatic charge pattern development, a conductive one-component toner is used by bringing a conductive support member bearing a layer of fine conductive toner powder into contact with the charge pattern bearing member as in U.S. Pat. No. 3,166,432 to Gundlach. In this case the toner is held to the support member by van der Waal's forces and the conductive support member is held at a bias potential during development. This technique fills in solid areas and requires only one component in the developer material.

A further method of developing an electrostatic charge pattern is to employ an electroscopic toner suspended in a liquid. With the proper choice of materials, the toner becomes charged to a definite polarity when dispersed in the liquid. When the electrostatic charge pattern bearing member is brought into contact with the liquid suspension, the toners deposit where there is a preponderance of charge of the opposite polarity as in cascade development.

While all of the above techniques have certain advantages in particular situations, each one suffers from disadvantages which impair their utility in actual machines.

In the conventional cascade development technique the toner-carrier combination has a definite charge polarity and is not reversible without changing the toner or the carrier. Thus, positive and negative developed images cannot easily be made. Also the images are hollow and solid areas are not filled in resulting in low-fidelity development compared to the original charge pattern. The triboelectric properties of the toner, while necessary to development, cause severe problems. Uneven charging of the toners causes backgrounding as do the uneven forces between carrier and toner result in varying threshold levels from toner to toner. Also, since the toner does not retain its charge for long periods of time, during cascading some toners escape the development region and enter other parts of the apparatus causing mechanical problems. These problems, coupled with the inherent problem of using a two-component system where only one component is depleted, definitely limit the utility of such techniques.

The conventional magnetic brush development, as it also uses carrier, suffers from some of the above mentioned disadvantages although it overcomes others. As mentioned above, this technique is less efficient but helps to fill in solid areas. However, it still requires triboelectric toners, which have the concomitant problems mentioned above. Also, due to the mechanicl brushing action and other electrical characteristics, this technique may result in high background depsition and poor machine latitude.

A system utilizing two different toners has been proposed in U.S. Pat. No. 3,262,806 wherein the toners acquire opposite charges when mixed with a carrier. This development system may be used for simultaneous development of images and background in two colors. This system is difficult to control as the two toners are not used at the same rate and it becomes unbalanced.

The process described in Gundlach, U.S. Pat. No. 3,166,432, has many advantages over the above mentioned cascade type techniques. However, it suffers from drawbacks which limit its applicability. The van der Waal's forces, which act to adhere the toner onto the conductive support member, are a counterforce to the image producing electric force generated by the electrostatic charge pattern, and as such must be selectively overcome to have toner deposited. The van der Waal's forces are weak and non-uniform from one toner to the next. Also high contrast is difficult to achieve. The fact that the van der Waal's forces are not under direct control but subject largely to the surface properties of the materials involved makes the system highly susceptible to alteration of development properties upon wearing of the involved surfaces or variations in ambient conditions of temperature and humidity.

In a liquid development technique most of the problems of cascade development are present in addition to others unique to a liquid system. Also, as in the case of cascade development, the charge on a given toner is not well controlled, resulting in high background deposition, poor machine latitude, and a characteristics splotchiness in large dark or grey areas. The inherent problems of the handling liquids, usually solvents, in a machine are also present.

There have been suggested systems for magnetic development not utilizing the carrier material. One such system was described in U.S. Pat. No. 2,846,333 to Wilson. Wilson et al disclosed the use of magnetic brush to apply toner particles formed of ferrites and resin material to develop electrostatic latent images. The difficulty with this process was the conductivity of the toner makes electrostatic transfer difficult.

A further development of electrostatic development without carriers is illustrated by Kotz, U.S. Pat. No. 3,909,258 wherein an electrostatic development process utilizing a magnetic toner brush is illustrated. A toner suitable for use in the Kotz process is disclosed in U.S. Pat. No. 3,639,245 to Nelson wherein a dry toner powder having specific electric conductivity is disclosed. The toner of Nelson is formed by blending magnetite with the resin and then after blending pulverizing to a small particle size. The particles are then mixed with conductive carbon black which is embedded in the surface of the particle to make it conductive and then a small particle size $SiO_2$ agent is mixed into the toner to improve the flowability. The toner of Nelson suffers the disadvantage that it does not transfer efficiently from a photoconductive substrate to plain bond paper.

Therefore there is a continuing need for toners suitable for use in carrierless development systems both with and without the use of magnetic development. There is a need for toners suitable for high speed development that also have good electrostatic transfer characteristics for high transfer efficiency from a photoconductive surface to plain bond paper.

SUMMARY OF THE INVENTION

It is an object of this invention to provide toners overcoming the above noted deficiencies.

It is another object to produce clear sharp images by magnetic brush development of electrostatic images without using a carrier.

It is an additional object to produce a toner for non-magnetic development system not using a carrier.

It is a further additional object to produce a development system free of triboelectric aging problems.

It is still another object to produce two component toner blends where the toner blend does not become unbalanced during use.

It is a further object to produce a toner that will transfer electrostatically from the photoreceptor to plain bond paper.

It is another additional object to form a toner suitable for high speed development by magnetic brush system without carrier.

It is a still further object to produce a toner that will transfer efficiently.

It is still an additional object of this invention to form toners that develop magnetically and transfer efficiently electrostatically.

It is another object to form toners which after transferred to paper adhere sufficiently well by electrostatic forces that image disturbances (blur) do not occur on handling prior to fusing.

These and other objects of the invention are generally accomplished by formation of a toner comprising a mixture of an electrically conductive toner and an insulating toner that are triboelectrically active with each other mixed together to form a two-component toner developer material for use without a carrier in development of electrostaic latent images.

In a specific embodiment in accordance with the instant invention a combination toner is formed of an insulating non-magnetic toner comprising carbon black in the amount of about 5% by weight and a polystyrene resin. This is mixed in a 50 parts by volume ratio with a conductive toner formed of a 40% by weight loading of magnetite in a styrene-n-butylmethacrylate resin. This combination of toner when utilized without carrier in a magnetic brush development system is found to form excellent images which transfer with an efficiency of greater than 70% to plain bond paper.

DESCRIPTION OF THE INVENTION

The combination of toners used to form the developer of the instant invention are selected such that they are triboelectrically active with each other. THe triboelectric toner properties are different when measured by means such as separate comparison of tribo of each toner with a common carrier. Further the triboelectric properties are such that when the combination toner is formed by the combination of insulating toner particles and conductive toner particles the triboelectric relationship is such that tribo is generated by the action of the toner combination. The particles of the combination toner of the instant invention generate triboelectric charges by the agitation of the combination of the two unlike materials. The insulating toner of the combination is selected so as to charge to a sign opposite to that of the image portion of the photoreceptor. The tribo relationship of various toner forming materials may be determined by reference to published tables, testing of toner combinations or forming one material into a carrier size particle, about 100 microns, and the other into a toner size particle, about 15 microns, and then measuring the tribo properties by a means such as the use of a Faraday Cage. The measurement of tribo with a Faraday Cage is described at column 11 of U.S. Pat. No. 3,533,845. The instant invention while utilizing triboelectric properties in development is not subject to triboelectric aging problems of carrier systems as both toners of the combination are utilized to develop the image and leave the system. In carrier systems the carrier ages and changes properties as it does not leave the system.

The instant invention further has advantages over single component magnetic toner brush development with toners such as in U.S. Pat. No. 3,639,245 to Nelson in that there is no image halo. The instant invention also allows adjustment of toner materials to develop either positive or negative electrostatic latent images.

The insulating toner which forms part of the combination toner of the instant invention may be selected from conventional insulating toners which are used in development processes utilizing a carrier, such as cascade and carrier using magnetic brushes. These insulating toners generally have a powder resistivity of greater than $10^{11}$ ohm-cm. A preferred resistivity is $10^{13}$–$10^{16}$ ohm-cm to give good electrostatic transfer in the instant invention.

The insulating and conductive toners may have incorporated therein any colorant which results in a suitable print when utilized with the magnetic toner with which it is combined. There are many dyes and pigments known for use in toners. Electrostatographic toner colorants are well known and include, for example, nigrosine dye, aniline blue, Calco Oil Blue, chrome yellow, chrome green, ultramarine blue, cobalt blue, duPont Oil Red, benzidine yellow, Quinoline Yelow, methylene blue chloride, phthalocyanine blue or green, Malachite Green Oxalate, Rose Bengal, and mixtures thereof. The pigment or dye, or pigment and dye, should be present in the toner in a sufficient quantity to render it highly colored so that it will form a clearly visible image on a recording member. Thus, for example, where conventional electrostatographic copies of typed documents are desired, the toner may comprise a black pigment such as carbon black or a black dye such as Amaplast Black dye, available from National Aniline Products, Inc. Preferably the pigment is employed in an amount from about 3 percent to about 20 percent by weight based on the total weight of the colored toner because better images are obtained. If the toner colorant employed is a dye, substantially smaller quantities of colorant may be used.

The conductive toner portion of the combination toner of the invention is characterized by a powder resistivity of between about $10^4$ and $10^{10}$ ohm-cm. The preferred resistivity is between about $10^4$ and about $10^6$ ohm-cm for good electrostatic development of the combination toner of the invention.

The powder resistivity difference between the insulating and conductive toner is suitably greater than $10^4$ ohm-cm. Generally a preferred difference is at least about $10^6$ ohm-cm between the resistivity of the conductive and insulating toners to give both good development and electrostatic transfer.

Although not wishing to be bound by any particular theory of operation it is believed that the surprising performance of the instant system may be explained as follows: The triboelectrically charged insulated particles are attracted to the oppositely charged electrostatic image, then the field in the vicinity of the conductive particle induces a charge into the conductive particles such that the particles on the outside of the brush are attracted with greater force to the image than they are held to the magnetic roll by magnetic forces. The potential of the magnetic brush also makes the conductive toner be attracted to the image.

The combination toner of the invention may be formed from any ratio of conductive toner to insulating toner that results in good images. A suitable range has been found to be between about 30 and about 80 percent by weight conductive toner in the combination toner. Too great an amount of insulating toner does not develop well. Whereas too great an amount of conductive toner does not transfer well. A preferred range has been found to be about 40 to about 70 percent by weight conductive toner in the combination toner for good development and transfer characteristics.

The development system utilized for the instant invention may be any method which brings the toner into contact with an electrostatic latent image without utilizing carrier beads. Typical of systems suitable for the instant invention are fluid bed development, cascade without carrier, fur brush and flooding a photoreceptor with toner and removing by vacuum or air pressure. The preferred development system of the instant invention is carrierless magnetic toner brush development as this means gives sharp images and low background. Further, the conductive toner of the combination toner of the invention is readily made magnetic by inclusion of magnetic pigment such as magnetite. It is also possible to include magnetic material in the insulating toner of the instant invention, as long as the insulating property is not lost by such inclusion.

The particle size of the combination toners of the invention may be any size which results in good quality images and satisfactory development and transfer. A suitable particle size range for both the conductive and insulating toner is greater than 95% of the particles between about 1 and about 40 microns. A preferred particle size range is greater than 95% of the particles between 5 and 30 microns to give sharp images.

The successful operation of the combination toner of this invention is surprising in that previous systems utilizing several toners with one carrier have not successfully transferred to the image the entire toner load, resulting in eventually a concentration of one type of toner being built up in the system. Surprisingly this has not happened in the instant system and further surprisingly development without carrier and transfer has been successful.

The preferrd conductive magnetic toners of the instant invention are referred to as magnetic because they are attracted to a magnet. They are not themselves magnets. The toners are held to a magnetic brush roller or belt by magnetic forces.

The magnetic pigment utilized in the magnetic toners of the invention may be any suitable particle which will give the desired magnetic properties. Typical of such materials are chromium oxides, ferrites, iron particles and nickel alloys. Preferred for the instant process are magnetite particles as they are black in color, low cost and provide excellent magnetic properties. The magnetite particles may be of any shape and any size which results in a conductive toner particles with good transfer properties. Generally the pigment particle size is between 0.02 micron and about 1 micron. A preferred average particle size for the magnetite particles is about 0.1 to 0.5 micron average particle size. The particles may be any shape including acicular or cubic shaped.

The transfer efficiency of the combination toners of the invention is greater than about 70 percent and generally reaches greater than 85 percent in ordinary electrostatic transfer.

The magnetic pigment may be utilized in the conductive magnetic toners in any amount that forms conductive and magnetic toner. A suitable range has been found to be a magnetic pigment content between about 40 and about 80 weight percent of magnetic particle in the finished magnetic conductive toner. A preferred range is a magnetite content between about 45 and 55 weight percent of magnetite for good development properties and good transfer.

The toner resins for both the conductive and insulating toner may be selected from any suitable toner resin material resulting in desirable triboelectric and fusing properties.

Any suitable resin possessing the properties as above described may be employed in the system of the present invention. Typical of such resins are polyamides, polyurethanes, epoxy, vinyl resins and polymeric esterification products of a dicarboxylic acid and a diol comprising a diphenol. Any suitable vinyl resin may be employed in the toners of the present system including homopolymers or copolymers of two or more vinyl monomers. Typical of such vinyl monomeric units include: styrene; p-chlorostyrene; vinyl naphthalane; ethylencally unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octylacrylate, 2-chloroethyl acrylate, phenyl acrylate, methyl-alpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl compounds such as N-vinyl pyrrol, N-vinyl carbazole, N-vinyl indole, N-vinyl pyrrolidene and the like; and mixtures thereof.

It is generally found that toner resins containing a relatively high percentage of styrene are preferred since greater image definition and density is obtained with their use. The styrene resin employed may be a homopolymer of styrene or styrene homologs or copolymers of styrene with other monomeric groups containing a single methylene group attached to a carbon atom by a double bond. Any of the above typical monomeric units may be copolymerized with styrene by addition polymerization. Styrene resins may also be formed by the polymerization of mixtures of two or more unsaturated monomeric materials with a styrene monomer. The addition polymerization technique employed embraces known polymerization technique such as free radical, anionic and cationic polymerization processes. Any of these vinyl resins may be employed including resin modified phenolformaldehyde resins, oil modified epoxy resins, polyurethane resins, cellulosic resins, polyether resins and mixtures thereof.

Polymeric esterification products of a dicarboxylic acid and a diol comprising a diphenol may also be used as a preferred resin material for the toner compositions of the instant invention. The diphenol reactant has the general formula:

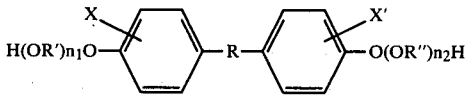

wherein R represents substituted and unsubstituted alkylene radicals having from 2 to 12 carbon atoms, alkylidene radicals having from 1 to 12 carbon atoms and cycloalkylidene radicals having from 3 to 12 carbon atoms; R' and R'' represent substituted and unsubstituted alkylene radicals having from 2 to 12 carbon atoms, alkylene arylene radicals having from 8 to 12 carbon atoms and arylene radicals; X and X' represents hydrogen or an alkyl radical having from 1 to 4 carbon atoms; and $n_1$ and $n_2$ are each at least 1 and the average sum of $n_1$ and $n_2$ is less than 21. Diphenols wherein R represents an alkylidene radical having from 2 to 4 carbon atoms and R' and R'' represents an alkylene radical having from 3 to 4 carbon atoms are preferred because greater blocking resistance, increased definition of xerographic characters and more complete transfer of toner images are achieved. Optimum results are obtained with diols in which R' is an isopropylidene radical and R' and R'' are selected from the group consisting of propylene and butylene radicals because the resins formed from these diols possess higher agglomeration resistance and penetrate extremely rapidly into paper receiving sheets under fusing conditions. Dicarboxylic acids having from 3 to 5 carbon atoms are preferred because the resulting toner resin possesses greater resistance to film formation on reusable imaging surfaces and resist the formation of fines under machine operation conditions. Preferred results are obtained with alpha unsaturated dicarboxylic acids including fumaric acid, maleic acid or maleic acid anhydride because maximum resistance to physical degradation of the toner as well as rapid melting properties are achieved. Any suitable diphenol which satisfies the above formula may be employed. Typical such diphenols include: 2,2-bis 4-beta hydroxy ethoxy phenyl)-propane, 2,2-bis(4-hydroxy isopropoxy phenyl)propane, 2,2-bis(4-beta hydroxy ethoxy phenyl)pentane, 2,2-bis(4-beta hydroxy ethoxy phenyl)-butane, 2,2-bis(4-hydroxy-propoxy-phenyl)-propane, 2,2-bis(4-hydroxy-propoxy-phenyl) propane, 1,1-bis(4-hydroxy-ethoxy-phenyl) heptane, 2,2-bis(3-methyl-4-betahydroxy ethoxy-phenyl) propane, 1,1-bis 4-beta hydroxy ethoxy phenyl)-cyclohexane, 2,2'-bis(4-beta hydroxy ethoxy phenyl)-norbornane, 2,2'-bis(4-beta hydroxy ethoxy phenyl) norbornane, 2,2-bis(4-beta hydroxy styryl oxyphenyl) propane, the polyoxyethylene ether of isopropylidene diphenol in which both phenolic hydroxyl groups are oxyethylated and the average number of oxyethylene groups per mole is 2.6, the polyoxypropylene ether of 2-butylidene diphenol in which both the phenolic hydroxy groups are oxyalkylated and the average number of oxypropylene groups per mole is 2.5, and the like. Diphenols wherein R represents an alkylidene radical having from 2 to 4 carbon atoms and R' and R'' represent an alkylene radical having from 3 to 4 carbon atoms are preferred because greater blocking resistance, increased definition of xerographic characters and more complete transfer of toner images are achieved. Optimum results are obtained with diols in which R is isopropylidene and R' and R'' are selected from the group consisting of propylene and butylene because the resins formed from these diols possess higher agglomeration resistance and penetrate extremely rapidly into paper receiving sheets under fusing conditions.

Any suitable dicarboxylic acid may be reacted with a diol as described above to form the toner compositions of this invention either substituted or unsubstituted, saturated or unsaturated, having the general formula:

$$HOOC\ R'''_{n3}\ COOH$$

wherein R''' represents a substituted or unsubstituted alkylene radical having from 1 to 12 carbon atoms, arylene radicals or alkylene arylene radicals having from 10 to 12 carbon atoms and $n_3$ is less than 2. Typical of such dicarboxylic acids including their existing anhydrides are: oxalic acid, malonic acid, succinic acid, glutaric acid, adipic acid, pimelic acid, suberic acid, azelaic acid, sebacic acid, phthalic acid, mesaconic acid, homophthalic acid, isophthalic acid, terephthalic acid, o-phenyleneacetic-beta-propionic acid, itaconic acid, maleic acid, maleic acid anhydride, fumaric acid, phthalic acid anhydride, traumatic acid, citraconic acid, and the like. Dicarboxylic acids having from 3 to 5 carbon atoms are preferred because the resulting toner resins possess greater resistance to film formation on resuable imaging surfaces and resist formation of fines under machine operation conditions. Optimum results are obtained with alpha unsaturated dicarboxylic acids including fumaric acid, maleic acid, or maleic acid anhydride because maximum resistance to physical degradation of the toner as well as rapid melting properties are achieved. The polymerization esterification products may themselves be copolymerized or blended with one or more other thermoplastic resins, preferably aromatic resins, aliphatic resins, or mixtures thereof. Typical thermoplastic resins include: resins modified phenol-formaldehyde resin, oil modified epoxy resins, polyurethane resins, cellulosic resins, vinyl type resins and mixtures therof. When the resin component of the toner contains an added resin, the added component should be present in an amount less than about 50 percent by weight based on the total weight of the resin present in the toner. A relatively high percentage of the polymeric diol and dicarboxylic acid condensation product in the resinous component of the toner is preferred because a greater reduction of fusing temperatures is achieved with a given quantity of additive material. Further, sharper images and denser images are obtained when a high percentage of the polymeric diol and dicarboxylic acid condensation product is present in the toner. Any suitable blending technique may be employed to incorporate the added resin into the toner mixture. The resulting resin blend is substantially homogeneous and highly compatible with pigments and dyes. Where suitable, the colorant may be added prior to, simultaneously with or subsequent to the blending or polymerization step.

Optimum electrophotographic results are achieved with styrene-butyl methacrylate copolymers, styrene-vinyltoluene copolymers, styrene-acrylate copolymers, polystyrene resins, predominately styrene or polystyrene based resins as generally described in U.S. Pat. No. 25,136 to Carlson and polystyrene blends as described in U.S. Pat. No. 2,788,288 to Rheinfrank and Jones.

Any conventional method of toner particle formation may be utilized in the instant invention which results in toner of the desired properties. Typical of known methods are spray drying, hot melt formation and mastication followed by attrition to toner particle size.

DESCRIPTION OF THE PREFERRED EMBODIMENT

The following Examples further define, describe and compare methods of preparing toners of the instant invention and of utilizing them in electrophotographic applications. Parts and percentages are by weight unless otherwise indicated.

EXAMPLE I

A conductive toner is formed by spray drying a slurry of about 100 grams magnetite MO-4232 from Pfiser and 48% Piccolastic D-125, a polystyrene, and about 400 grams toluene. This mixture is spray dried to an average 15 micron particle size using a Bowen spray dryer at a feed rate of about 200 milliliters at a temperature of about 200° F. A non-magnetic insulating toner is formed by spray drying a slurry of 800 grams toluene, about 200 grams polymethyl methacrylate and about 8 parts by weight of Raven 330 carbon black to toner particle size of about 15 microns. These toners were mixed in equal parts by weight and utilized to develop an electrostatic image by use of a magnetic applicator roll. The photoreceptor image has a positive charge. The toner is found to successfully develop the electrostatic image and transfer at about a 70% efficiency rate. Further the toner fuses to form a clear sharp uniform image with a conventional Teflon coated internally heated fuser roll lubricated with silicone oil.

EXAMPLE II

A combination toner is formed of equal parts of the conductive magnetic toner commercially available from 3-M as 842 VHS, believed to be a blend of magnetite and a copolymer of epoxy and styrene, and an insulating toner formed of about 7 percent by weight carbon black in 65/35 styrene-n-butylmethacrylate resin. This toner combination is used to develop an electrostatic image by the use of a magnetic applicator roll biased to a negative charge. The toner developes, electrostatically transfers and fuses successfully.

EXAMPLE III

A combination toner is formed of equal parts by weight of a conductive toner of 50 parts by weight magnetite and 50 parts by weight of a 50/50 copolymer of styrene butadiene and an insulating toner of 5 parts by weight Neospectra Mark II Carbon Black and 95 parts by weight EPON 1004 a polyhydroxyether epoxy of Shell. The toners are both produced by mastication and attrition to about a 25 micron particle size. The development, transfer and fusing is carried out as in Example I and results in good, low background images.

EXAMPLE IV

A combination toner is formed of equal parts by weight of a conductive toner of 55 parts by weight magnetite and 45 parts by weight of a low molecular weight bisphenol A polymer and an insulating toner of 5% by weight Neospectra Mark II carbon black and 95 parts by weight of low molecular weight styrene-maleic anhydride. Both toners are produced by conventional mastication and attrition to an average toner particle size of 20 microns. This toner combination successfully developes with an unbiased magnetic brush system. The toner further transfers electrostatically to plain paper and fuses with a conventional silicone lubricated internally heated Teflon coated fuser roll system.

EXAMPLE V

A conductive toner is formed of 60 parts by weight poly(hexamethyl sebacate) and 40 parts by weight magnetite by mastication and attrition to form toner particles of an average particle size of 20 microns. An insulating toner is formed by mastication and attrition of a blend of 5 parts by weight Raven 330 carbon black and 95 parts by weight ethyl cellulose. A combination toner of equal parts of the above toners developes well using a biased magnetic roller. The toner further transfers from the photoreceptor electrostatically and is fusable by conventional methods.

EXAMPLE VI

As a control, Example II is repeated except the insulating toner is utilized in cascade without carrier and without combination with an electrically conductive toner. Development is poor. Only the edges of the image develop while the middle portion is not covered.

EXAMPLE VII

As a control, Example II is repeated except development is accomplished with only the magnetic toner in the system without combination with the insulating toner. Electrostatic transfer of this toner after development is only about 45% efficient. Whereas the mixture of toners transferred at about 70% efficiency.

EXAMPLE VIII

This example illustrates performance of the instant invention with a combination toner of magnetic insulating toner and magnetic conductive toner. An insulating magnetic toner is formed by spray drying from a toluene slurry to form a toner of 65 parts by weight styrene-n-butylmethacrylate, 32 parts magnetite, Pfizer 4232, and 2 percent by weight Neospectra Carbon Black to form a toner of about 15 microns average particle size. This is combined with an equal part by weight of the magnetic conductive toner of Example V. This combination toner successfully developes an electrostatic image with a biased magnetic toner brush system and electrostatically transfers at over 70 percent efficiency to plain paper.

EXAMPLE IX

This example illustrates the combination toner and imaging process of the invention utilizing a magnetic insulating toner and non-magnetic electrically conductive toner. The insulating magnetic toner of Example VIII is mixed with an equal part of a conductive non-magnetic toner formed by mastication and attrition to form a toner comprising about 92 percent by weight poly(hexamethylene sebacate), 4 percent by weight Raven 300 carbon black and 3 percent by weight Nigrosine dye. This combination toner successfully electrostatically developes in a biased carrierless magnetic toner brush system. It also transfers electrostatically to plain paper at over 70 percent efficiency.

The resistivity measurements for toner used throughout this application are determined by the following process. Measurements on powder are complicated by the fact that the results are influenced by characteristics of the powder particles shape and size in addition to powder composition. Therefore, measurements were obtained on powder rather than by molding the powder into a pellet specimen in order to better relate the properties to the toner behavior in development. The measurements were made using a two inch diameter electrode of a Balsbaugh cell for measuring the direct current resistivity of the toner. The gap distance is 0.05 inch. The toner is packed between the electrodes of the cell by vibration until a constant bed volume is reached. The current is measured as a function of applied voltage at the 50 mil gap. The electrification time is 1 minute as recommended by ASTM method. After each measurement the sample is repacked by vibration. Resistivity is calculated according to Ohms law.

The transfer efficiency in this application is measured comparing the weight of toner transferred to a paper with the weight of toner remaining on the photoreceptor and removed by an adhesive tape applied thereto after transfer to paper is completed.

Although specific materials and conditions were set forth in the above exemplary processes in the formation and using the toner of the invention these are merely intended as illustrations of the present invention. Various other substituents and processes such as those listed above may be substituted for those in the examples with similar results. In addition to the steps used by the toner of the present invention other steps or modifications may be used. For instance the toner could be classified prior to utilization for developing and transfer. In addition other materials such as plasticizers and flowability regulators could be added.

Other modifications of the present invention will occur to those skilled in the art upon reading the present disclosure. These are intended to be included within the scope of this invention. For instance, the magnetic toner of this invention could be utilized in conventional magnetic development onto zinc oxide paper where transfer does not take place. Further the toner of the invention could be utilized for processes requiring development of magnetic images rather than electrostatic latent images.

What is claimed is:

1. A method of imaging comprising forming an electrostatic latent image on a surface, contacting said surface with a toner composition free of carrier particles, said toner composition comprising a mixture of electrically insulating toner particles and electrically conductive toner particles, said insulating toner particles and said conductive toner particles being triboelectrically active with each other whereby said electrically conductive toner particles triboelectrically impart a charge of a selected polarity to said insulating toner particles, said insulating toner particles being present in an amount from about 20 percent to about 70 percent by weight of said toner composition and having a powder resisitivity greater than about $10^{11}$ ohm-cm and said conductive toner particles being present in an amount from about 80 percent to about 30 percent by weight of said toner composition and having a powder resisitivity of from about $10^4$ ohm-cm to about $10^{10}$ ohm-cm, each of said insulating toner particles and said conductive toner particles having a particle size range of from about 1 micron to about 40 microns, whereby both said insulating toner particles and said conductive toner particles develop onto said surface in conformance with said electrostatic latent image to form a toner image, electrostatically transferring said toner image to a receiving member, and fixing said toner image to said receiving member.

2. A method of imaging in accordance with claim 1 wherein said conductive toner particles comprise resin and magnetic particles.

3. A method of imaging in accordance with claim 1 wherein said fixing of said toner image is accomplished by fusing said image.

4. A method of imaging in accordance with claim 1 wherein said conductive toner particles comprise between about 40 percent and about 70 percent by weight of said toner composition.

5. A method of imaging in accordance with claim 1 wherein said conductive toner particles and said insulating toner particles have different triboelectric properties when compared with a common carrier.

6. A method of imaging in accordance with claim 2 wherein said magnetic particles comprise magnetite.

7. A method of imaging in accordance with claim 1 wherein said insulating toner particles and said conductive toner particles have a particle size range between about 5 microns and about 30 microns.

8. A method of imaging in accordance with claim 1 wherein said insulating toner particles and said conductive toner particles have a resistivity difference of greater than about $10^4$ ohm-cm.

9. A method of imaging in accordance with claim 1 wherein said insulating toner particles and said conductive toner particles have a resistivity difference of greater than about $10^6$ ohm-cm.

10. A method of imaging in accordance with claim 1 wherein said conductive toner is magnetic.

11. A method of imaging in accordance with claim 1 wherein said receiving member is plain paper.

12. A method of imaging in accordance with claim 1 wherein only said insulating toner particles are magnetic.

13. A method of imaging in accordance with claim 1 wherein only said conductive toner particles are magnetic.

14. A method of imaging in accordance with claim 1 wherein both said insulating toner particles and said conductive toner particles are magnetic.

15. A method of imaging in accordance with claim 2 wherein at least 70 percent of said toner image is transferred to said receiving member.

* * * * *